United States Patent [19]

Kramer

[11] Patent Number: 4,744,184

[45] Date of Patent: May 17, 1988

[54] PARTITION

[75] Inventor: Walter Kramer, Steinen, Fed. Rep. of Germany

[73] Assignee: Plattex GmbH, Steinen, Fed. Rep. of Germany

[21] Appl. No.: 920,258

[22] Filed: Oct. 16, 1986

[30] Foreign Application Priority Data

Oct. 16, 1985 [DE] Fed. Rep. of Germany ..... 3536829

[51] Int. Cl.[4] ..... E04H 1/00

[52] U.S. Cl. ..... 52/227; 52/239

[58] Field of Search ..... 52/227, 228, 239; 256/24, 19, 73, 25, 29

[56] References Cited

U.S. PATENT DOCUMENTS

| | | | |
|---|---|---|---|
| 712,670 | 11/1902 | Haffner | 52/227 |
| 2,094,265 | 9/1937 | Curren | 52/227 |
| 2,208,671 | 7/1940 | Gerber | 52/227 |
| 2,803,856 | 8/1957 | Kofhal | 52/227 |
| 4,559,750 | 12/1985 | Scourtelis | 52/239 |
| 4,606,161 | 8/1986 | Hosoe | 52/239 |

FOREIGN PATENT DOCUMENTS

| | | | |
|---|---|---|---|
| 116918 | 5/1943 | Australia | 52/228 |
| 95435 | 6/1923 | Austria | 52/233 |
| A22283V | 9/1955 | Fed. Rep. of Germany | 52/227 |
| 363705 | 12/1931 | United Kingdom | 52/233 |
| 557025 | 11/1943 | United Kingdom | 52/228 |

OTHER PUBLICATIONS

Popular Mechanics, Jun. 1930, p. 135.

*Primary Examiner*—John E. Murtagh
*Attorney, Agent, or Firm*—Peter K. Kontler

[57] ABSTRACT

A partition which can be used in offices or like establishments has a row of neighboring upright rod-shaped sound-absorbing components with transversely extending openings for several flexible strip- or band-shaped metallic coupling elements in the form of leaf springs which enable the partition to be flexed so that the components are located in a common plane or together form a U-shaped, S-shaped, L-shaped or a like panel. The end portions of the flexible coupling elements are secured to the corresponding outer components, and the securing means can be provided with devices for coupling the partition to an adjacent partition. Certain rod-shaped components carry legs which are weighted and have roughened floor-contacting surfaces so as to reduce the likelihood of unintentional slippage of the feet relative to the floor, particularly when the rod-shaped components are not disposed in a common plane. The neighboring components can be assembled in partly compressed condition so as to tension the flexible coupling elements.

25 Claims, 3 Drawing Sheets

PARTITION

BACKGROUND OF THE INVENTION

The present invention relates to partitions in general, and more particularly to improvements in partitions which contain a sound-absorbing material. Still more particularly, the invention relates to improvements in partitions which are, or can be, of the self-supporting type so that they can be placed onto and held in requisite position on the top surface of a floor or the like.

German Pat. No. 20 49 836 discloses a sound-absorbing partition which comprises a frame flanked by two panels and elastic inserts between the two panels. Such partition is intended for suspension on suitable supports so that it can be used only for a limited number of purposes. Moreover, the partition is rigid so that it cannot readily conform to the outlines of certain parts which are to be concealed thereby or which are to be separated from other parts.

It is also known to provide a mobile partition with feet and to use such mobile partition as a means for subdividing larger areas into smaller compartments, for example, in offices and like establishments. Reference may be had to German Utility Model No. 1,929,201. A drawback of such conventional partitions is that they are at least substantially rigid so that they cannot readily alter their shape, for example, to constitute walls which are not flat but have a substantially sinusoidal, concavo-convex or similar shape.

U.S. Pat. No. 4,428,174 discloses a modular wall construction wherein concrete uprights having a polygonal cross-sectional outline are assembled into a wall and are held together by threaded bolts and nuts.

German Utility Model No. 84 34 779.1 discloses a solid and rigid wall which is assembled of discrete modules held together by bolts and nuts in such a way that pairs of neighboring modules are rigidly secured to each other. The wall is supposed to act as a sound barrier and its dimensions can be altered.

OBJECTS AND SUMMARY OF THE INVENTION

An object of the invention is to provide a partition, particularly a mobile partition, which is constructed and assembled in such a way that its configuration can be altered in a number of ways without affecting its stability.

Another object of the invention is to provide a partition which not only exhibits highly satisfactory sound-absorbing characteristics but is also of eye-pleasing appearance and can be furnished in any desired size and/or shape.

A further object of the invention is to provide novel and improved components for assembly into a partition of the above outlined character.

An additional object of the invention is to provide a partition whose versatility greatly exceeds that of conventional partitions but the cost of which is not higher, and can be much lower, than that of conventional partitions.

Still another object of the invention is to provide a partition which can be readily attached to or separated from similar partitions.

A further object of the invention is to provide a partition which can be used as a superior substitute for conventional partitions and which can be readily transferred from one location of use to another location.

A further object of the invention is to provide a partition the length of which can be increased or reduced practically at will.

An additional object of the invention is to provide a substantially fence-like partition which is rigid in a first direction but is readily deformable in a second direction at right angles to the first direction.

Another object of the invention is to provide novel and improved means for holding the components of the fence-like partition in requisite positions relative to each other.

The invention resides in the provision of a partition, particularly a mobile upright partition for use in offices and other establishments. The partition comprises a plurality of substantially rod-shaped elongated parallel components which are disposed side by side and include a plurality of intermediate components and first and second outer components flanking the intermediate components. Each of the components has at least one transversely extending passage and the passages of neighboring components are at least substantially aligned with each other. The partition further comprises coupling means including at least one flexible coupling element which extends through the passages and has first and second end portions adjacent the first and second outer components, respectively, and first and second means for securing the end portions of the coupling element to the respective outer components so that the components can be moved relative to each other into and out of a common plane. The coupling element can comprise a band having a polygonal cross-sectional outline and being disposed in a plane which is parallel to or includes the axes of the rod-shaped components. The components together constitute a row of abutting components which preferably tension the coupling element.

The arrangement is or can be such that the components are at least substantially vertical when the partition is in actual use.

The coupling element can include a leaf spring which contains or consists of a suitable metallic material.

In accordance with a presently preferred embodiment, each of the components has several passages and such passages together form several rows of aligned passages. The coupling means then comprises a coupling element for each row of passages.

At least some of the components can include elongated cylinders having substantially diametrically extending transverse openings which constitute the respective passages. Such cylinders have peripheral surfaces and the peripheral surfaces of neighboring cylinders are in actual contact with each other.

At least some of the components can include elongated cores (such as metallic reinforcing tubes) and layers of suitable sound-absorbing material which surround the respective cores.

Means can be provided to clamp at least some of the components to the coupling element or elements. Such clamping means can comprise bolts or screws which engage the flat sides of the coupling element or elements to hold them against longitudinal movement relative to the respective components or to limit longitudinal movements of the coupling element or elements relative to the respective components. At least some of the components can be provided with guide means disposed in the respective passages and at least partially surrounding the respective portion or portions of the coupling element or elements. Such guide means can consist of or can contain a plastic material. For example, the guide means can be made of a self-lubricating material so as to avoid the generation of noise in response to longitudinal shifting (if any) of the coupling element or elements relative to the respective components.

The partition can further comprise feet which are provided on at least some of the components and can be placed into contact with a floor or another support. The arrangement may be such that one foot is disposed in the region of each securing means, and the feet are preferably separably affixed to the respective components. The feet can include weight-enhancing metallic elements and roughened exposed surfaces which are engagable with the support to reduce the likelihood of uncontrolled shifting of the feet along the support, for example, when the partition is deformed so as to form a substantially S-shaped, U-shaped, V-shaped, C-shaped, L-shaped or otherwise configurated body.

In order to enhance the appearance of the partition, it may be desirable to stagger certain components relative to the other components. This can be achieved by providing at least one first group of components with passages which are disposed at first distances from the end portions of such components, and to provide at least one second group of components with passages which are disposed at different second distances from the end portions of such components. Such distribution of passages renders it possible to assemble the components into a panel or fence which is flexible and wherein certain components extend upwardly or downwardly beyond the neighboring components. This construction may be desirable on the additional ground that it enhances the flow of air between the opposite sides of the improved partition.

At least one of the securing means can comprise an anchor which is affixed to the respective end portion of the coupling element. Such anchor can comprise two legs which flank the respective end portion of the coupling element and are riveted or otherwise secured thereto, and the securing means can further comprise a carrier which is adjacent to one of the outer components and has internal abutments for the legs of the anchor. The carrier can constitute a substantially semi-cylindrical shell having a concave internal surface provided with two undercut portions which constitute the abutments.

At least one of the securing means and/or at least one of the outer components can include means for separably connecting the partition to a second partition. For example, such connecting means can comprise an eyelet or a hook whereby the eyelet receives the hook of the neighboring partition or the hook is engagable with the eyelet of a neighboring partition.

At least some of the components can be constructed in such a way that they are compressible in the direction of their respective passages, and the compressible components are assembled with neighboring components in compressed condition so as to exert a longitudinal tensional stress upon the coupling element. Each component can, but need not, have the same length.

The novel features which are considered as characteristic of the invention are set forth in particular in the appended claims. The improved partition itself, however, both as to its construction and the mode of assembling and utilizing the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
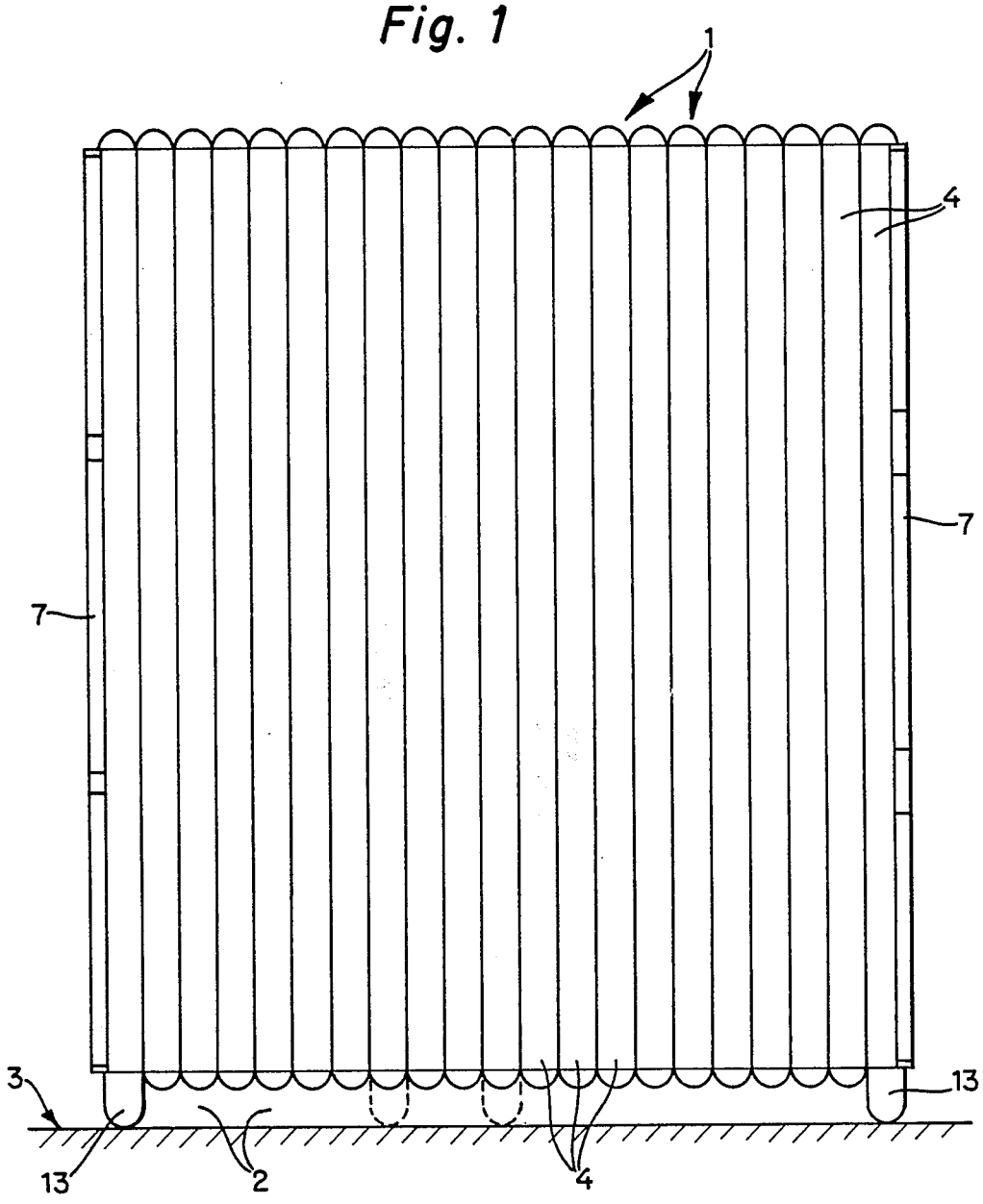
FIG. 1 is a schematic elevational view of a partition which embodies one form of the invention and has several legs resting on the top surface of a floor or a similar support.

FIG. 1 shows a mobile upright partition 1 which can be transported, shifted or carried to different locations of use and is provided with feet 13 to ensure that the lowermost portion of the partition and the upper surface of a support (such as a floor 3) define a clearance 2. A similar clearance can be provided between the uppermost portion of the partition 1 and a ceiling (not shown) of the room in which the partition is put to use.

In accordance with a feature of the invention, the partition 1 comprises a plurality of upright elongated rod-shaped (preferably cylindrical) components 4 which are disposed side by side and the cylindrical peripheral surfaces of which preferably contact each other along lines extending in parallelism with the axes of the respective rod-shaped components. Each component 4 has several (for example, four) transversely extending passages 5 in the form of diametrically extending slots for the respective leaf springs 6 which constitute flexible coupling elements of the improved partition 1. The two outermost or outer components 4 are adjacent to means for securing the end portions of the coupling elements 6 to the respective outer components, and each securing means comprises an elongated hollow concavo-convex carrier or shell 7 as well as a discrete anchor 16 for each coupling element.

The illustrated coupling elements 6 are elongated flat leaf springs which are made of or contain layers of suitable metallic material. The arrangement is such that the planes of the coupling elements 6 are disposed in or are parallel to the axes of the components 4. The illustrated coupling elements 6 have a polygonal (preferably elongated rectangular) cross-sectional outline. This can be readily seen in FIGS. 3 and 4. The neighboring components 4 preferably abut each other, and at least some of the components are preferably subjected to at least some compressive force in the direction of the passages 5 so as to maintain the coupling elements 6 under longitudinal tension. This reduces the likelihood of accidental shifting of the components 4 longitudinally of the coupling elements 6 and/or vice versa. Furthermore, this imparts to the coupling elements 6 a tendency to maintain the components 4 in a common vertical plane.

The strength (particularly the resistance to breaking) of the coupling elements 6 should suffice to allow for at least some deformation of the partition 1 so as to impart to the fence including the intermediate and outer components 4 a substantially S-shaped, U-shaped, L-shaped, V-shaped, C-shaped or other configuration, depending upon the desired configuration of the partition while it is being used to conceal one or more items or objects in a room or to subdivide the room into compartments having specific shapes.

It is preferred to provide the partition 1 with at least two coupling elements 6 one of which is closely or rather closely adjacent the upper ends and the other of which is closely or rather closely adjacent the lower ends of the components 4. One or more intermediate coupling elements 6 can be provided in addition to the two outer coupling elements to further enhance the strength and stability of the partition 1 as well as its ability to retain a shape in which the components 4 are located in a common plane.

The feature that the passages or openings 5 in the form of elongated narrow slots extend diametrically of the respective components 4 is desirable and advantageous because this renders it possible to flex each portion of the partition 1 in two different directions. The external surfaces of the components 4 are preferably cylindrical surfaces; however, it is also sufficient to provide the components 4 with portions of cylindrical surfaces in regions where the neighboring components contact each other. The just described configuration and distribution of passages 5 renders it possible to impart to the partition 1 a reasonably complex shape, for example, a substantially S-shaped configuration.

Figure 2:
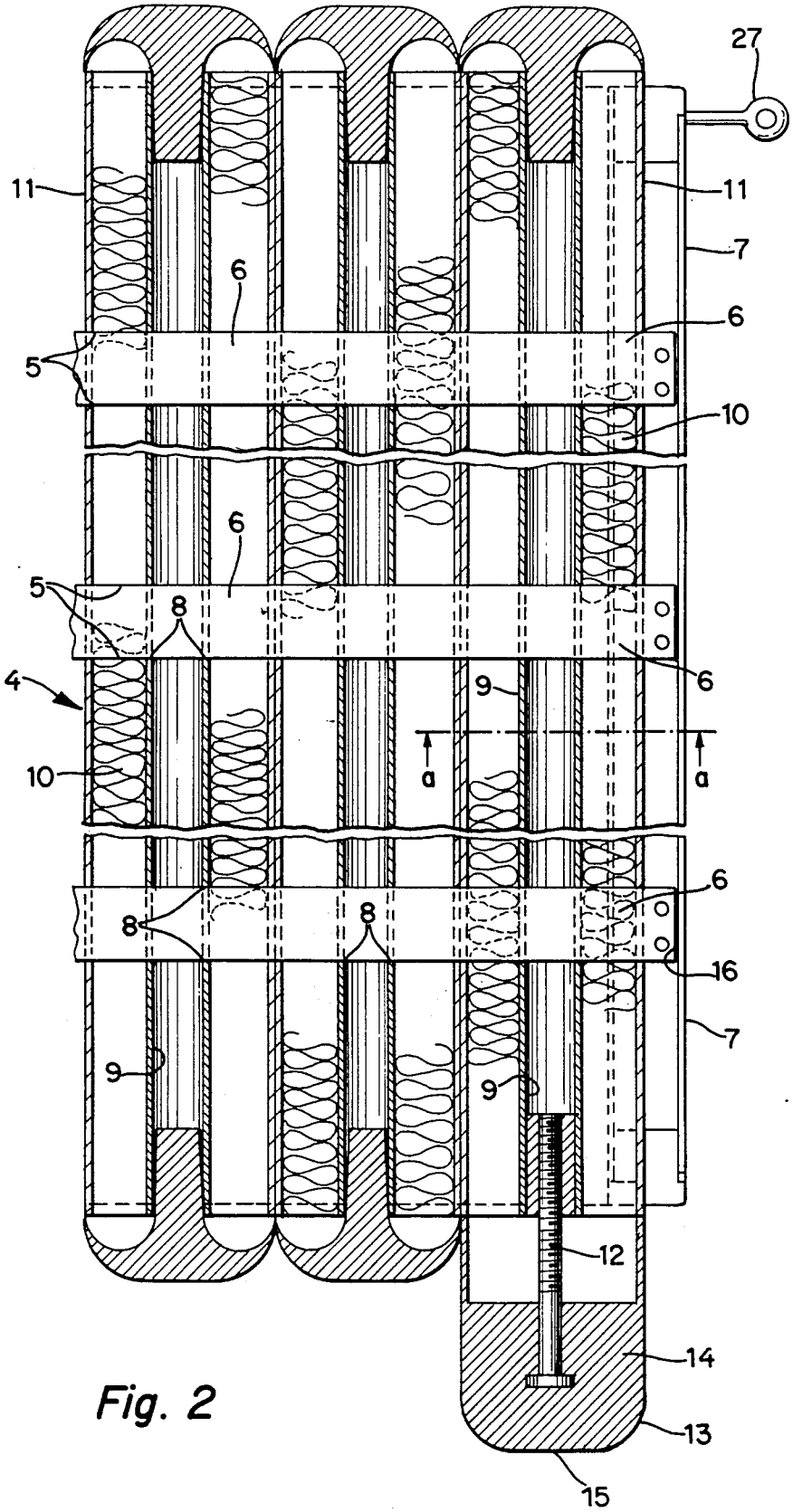
FIG. 2 is an enlarged vertical sectional view of three neighboring rod-shaped components including an outer component, and of means for securing the end portions of several flexible coupling elements to the outer component.
Figure 5:
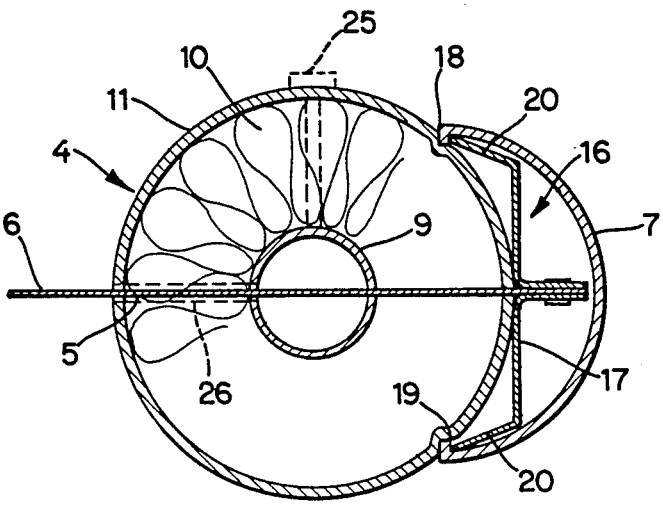
FIG. 5 shows the structure of FIG. 4 as well as the adjacent outer component in a horizontal sectional view.

As shown in FIGS. 2 and 5, each component 4 can comprise an elongated tubular core 9 which consists of or contains a suitable metallic material so that it can stand substantial deforming (particularly bending) stresses. Each tubular core 9 has several transversely extending diametrical slots 8 which constitute portions of passages 5 for the corresponding coupling elements 6. Each core 9 is surrounded by a hollow cylindrical layer 10 of sound-absorbing material of any known composition. For example, the layer 10 can be made of a foamed synthetic plastic material. Each component 4 can further comprise a cylindrical outer layer or shell 11 which surrounds the respective layer 10 of sound-absorbing material and the external surface of which is in linear contact with the external surface of the shell 11 forming part of a neighboring component 4, or with external surfaces of cylindrical shells 11 forming part of two neighboring components 4, depending upon whether the component 4 in question is an outer component or an intermediate component of the partition 1. The layers 10 can be assembled of multiple strata of radially extending foamed or other sound-absorbing material so as to increase the overall area of external and internal surfaces of the layers 10 with attendant enhancement or improvement of their sound-absorbing action.

The partition 1 can be assembled in a simple, time-saving and inexpensive manner by the simple expedient of stringing the components 4 onto the coupling elements 6 and by thereupon completing the assembly of the securing means 7 and 16 so as to prevent axial shifting of the coupling elements 6 relative to the components 4. The cores 9 carry the weight of the partition 1 and resist undesirable transverse bending or other deforming stresses, while the layers 10 absorb sounds and the outer shells 11 enhance the appearance of the components 4.

FIG. 5 shows a clamping device 25 which is used to secure or affix the corresponding outer component 4 to the adjacent portion of the illustrated flexible coupling element 6. The clamping device 25 can be used in conjunction with a second clamping device which is disposed opposite thereto with reference to the vertical axis of the outer component 4 so as to engage the adjacent portion of the flexible coupling element 6 and to prevent the coupling element from changing its position relative to the outer component. Similar or analogous clamping devices 25 can be provided to secure or affix the other (e.g., all intermediate) components 4 to the coupling elements 6. This greatly reduces the likelihood of the development of vertical gaps between neighboring vertically extending components 4. The utilization of clamping devices 25 or similar clamping devices is particularly desirable and advantageous if the partition 1 comprises relatively large-diameter components 4. It is not absolutely necessary that the clamping devices 25 extend substantially radially of the respective components 4, as long as they ensure that the flexible coupling elements 6 are properly held against longitudinal shifting relative to the components 4 and/or vice versa. The provision of clamping devices 25 is also desirable and advantageous if the outer shells 11 and the sound-absorbing layers 10 of the components 4 are relatively soft and hence readily deformable so that, in the absence of clamping devices 25, each of the components 4 (or at least some of the components) could undergo substantial deforming action by moving longitudinally of the coupling elements 6. It has been found that the clamping devices 25 are not absolutely necessary if the partition 1 comprises relatively thin (small-diameter) components 4. However, the utilization of clamping devices 25 or analogous clamping means is normally desirable and advantageous for all types of components 4 irrespective of their diameters.

FIG. 5 further shows a plastic tubular guide 26 which is inserted into the illustrated outer component 4 to surround the adjacent portion of the flexible coupling element 6. This guide can be made of a plastic material which is self-lubricating and greatly reduces wear upon the adjacent portion of the coupling element 6. The exact manner in which the guides 26 can be anchored in the components 4 forms no part of the present invention. Each guide 26 can extend through the outer shell 11, through the sound-absorbing layer 10 and through the core 9 of the respective component 4. Each component 4 can carry a single guide 26 for each flexible coupling element 6 or a pair of aligned guides for each coupling element. The provision of relatively stiff guides 26 is particularly desirable if the material of the cores 9 and/or layers 10 and/or outer shells 11 is relatively soft so that the metallic or partly metallic coupling elements 6 could cause a pronounced deformation of the layers 10 and/or shells 11 in response to deformation of the partition 1 from a shape in which the components 4 are disposed in a common plane to a shape in which the components 4 together form a substantially U-shaped, L-shaped, V-shaped, S-shaped, C-shaped and/or otherwise configurated partition.

FIG. 2 shows the details of one foot 13 of the improved partition. This foot can be provided on the respective end portion of the corresponding outer component 4 and has a length such as to ensure the establishment of a clearance 2 having a requisite width. Each foot 13 can comprise an externally threaded shank 12 which mates with an internally threaded sleeve of the corresponding component 4. Furthermore, each foot 13 can comprise a weight-enhancing metallic element 14 and each foot 13 can have a roughened bottom surface 15 so as to reduce the likelihood of accidental slippage of the foot 13 along the surface of the floor 3. The metallic elements 14 contribute to greater weight of the respective feet 13 and, consequently, also contribute to a reduction of the likelihood of accidental slippage or shifting of the feet 13 along the floor 3 or any other support. The provision of roughened external surfaces 15 and/or metallic elements 14 is desirable but optional. Such design of the feet 13 is particularly desirable if the partition 1 is to be deformed to a considerable extent so that the positions of the components 4 greatly deviate from the positions shown in FIG. 1 in which all of the components 4 are assumed to be located in a common vertical plane including the axes of all cores 9.

Figure 3:
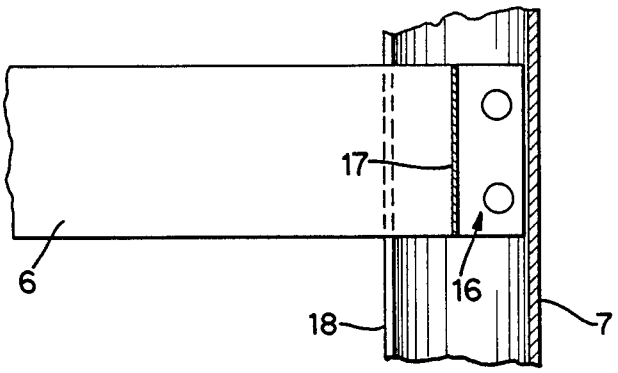
FIG. 3 is an enlarged view of a detail in FIG. 2 and shows the manner of attaching one end portion of a flexible coupling element to the respective securing means.
Figure 4:
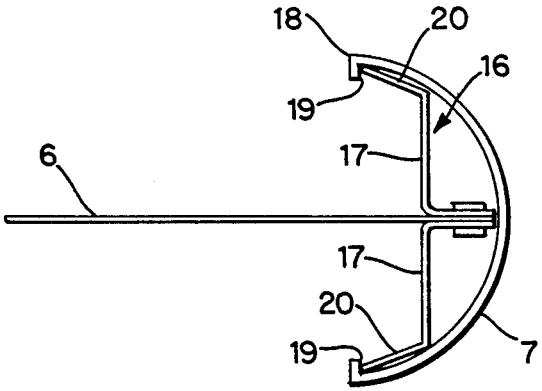
FIG. 4 is a plan view of the structure which is shown in FIG. 3.

The manner in which the end portions of the flexible coupling elements 6 are secured to the respective outer components 4 of the partition 1 is illustrated in FIGS. 3, 4 and 5. As mentioned before, the securing means comprises two concavo-convex shell-shaped carriers 7 which are adjacent to the respective outer components 4 and each of which receives a discrete anchor 16 for each of the coupling elements 6. Each anchor 16 has two mirror symmetrical legs 17 which are permanently or quasi-permanently affixed (preferably riveted) to the respective sides of the corresponding coupling elements 6. Furthermore, the legs 17 have bent end portions 20 which extend toward the respective outer component 4 and abut undercut portions 19 which are provided in the interior of the respective carrier 7 adjacent its edge faces 18. The edge faces 18 abut the external surface of the respective outer component 4 and can subject such outer component to at least some deforming action (see FIG. 5). The carriers 7 confine the respective anchors 16 to enhance the appearance of the partition. Furthermore, at least one of the carriers 7 can be provided with means (27) for separably connecting the illustrated partition 1 to a neighboring partition which may but need not be identical with the illustrated partition. The connecting means 27 which is shown in the upper right-hand portion of FIG. 2 comprises an eyelet which can receive a pivotable hook (not shown) provided on the neighboring partition. The positions of the eyelet and hook can be interchanged, or each of the carriers 7 can comprise two eyelets 27, two hooks, or one hook and one eyelet. This renders it possible to connect the illustrated partition 1 to a single additional partition or to place it between and to connect it to two neighboring partitions, not shown. It will be seen that each securing means including a carrier 7 and several anchors 16 can perform several functions including connecting the end portions of the coupling elements 6 to the corresponding outer component 4 as well as of separably connecting the illustrated partition to one or more neighboring partitions.

The illustrated anchors 16 can be replaced with differently configurated and/or constructed anchors without departing from the spirit of the invention. An advantage of the illustrated anchors is their simplicity and the ease with which they can be installed in the respective carriers 7 and riveted or otherwise secured to the respective end portions of the corresponding flexible coupling elements 6. Each coupling element 6 can be tensioned by properly selecting the positions of the anchors 16 and/or by causing the coupling elements to extend through a reasonably large number of components 4 so that the neighboring components undergo at least some deformation which, in turn, entails a desirable tensioning of the coupling elements 6.

It is also possible to enhance the appearance and/or other desirable characteristics of the improved partition by selecting the positions of the passages 5 in such a way that the neighboring or selected components 4 are staggered relative to each other in the longitudinal direction of such components. For example, the partition 1 can comprise a first group of components 1 wherein the passages 5 are disposed at first distances from the end portions of such components, and at least one second group of components wherein the passages 5 are located at different second distances from the end portions of the respective components. When the two groups of components are assembled on common flexible coupling elements 6, the upper end portions of one group of components extend upwardly beyond the upper end portions of the other group of components. This can serve to merely enhance the appearance of the partition and/or to ensure that larger quantities of air can flow between opposite sides of the erected partition.

An important advantage of the improved partition is its stability regardless of the configuration of the panel which is formed by its components 4. Another important advantage of the improved partition is that it can be caused to assume any one of a number of different shapes without affecting the sound-absorbing characteristics of the components 4 and/or the stability of the partition on a floor or another support. The panel of fence including the components 4 can be deformed transversely of the longitudinal directions of the components without the need for the establishment of gaps between neighboring components.

Another important advantage of the improved partition is that it can be assembled without the need for a rigid frame and/or one or more rigid panels which are customary in many conventional partitions. All that is necessary is to use one or more flexible coupling elements 6, a requisite number of components 4, and suitable means for securing the end portions of each flexible coupling element to the outermost components 4. The feature that the neighboring components 4 abut or can abut each other enhances the sound-proofing quality of the partition and contributes to a more satisfactory appearance of the partition. Still further, this renders it unnecessary or optional to provide the aforediscussed clamping devices 25.

The utilization of coupling elements 6 in the form of flat leaf springs or the like ensures that the partition can be readily deformed but that the neighboring components 4 are pressed against each other with a requisite force. The leaf springs which constitute or form part of coupling elements 6 enhance the stability and rigidity of the entire partition, especially if the components 4 are mounted in such a way that they extend vertically or substantially vertically. Leaf springs render it possible to readily flex the partition, even if the leaf springs are subjected to pronounced longitudinal tensional stresses. Metallic leaf springs have been found to be particularly desirable because they can be mass-produced at a low cost and because their stability and resistance to tensional stresses are very pronounced. The number of coupling elements will depend upon the overall dimensions of the partition, upon the diameters of the components 4, upon the mass and weight of the components, and upon the desired tendency of the components 4 to move into a common plane.

The utilization of substantially rod-shaped components 4 which contain a sound-absorbing material contributes to a highly pronounced interception and suppression of noise. This is attributable to the provision of the layer or layers 10 on the one hand as well as to the circular cross-sectional outline of the outer layers 11 on the other hand. The sound-absorbing capacity of the partition 1 is further enhanced due to the fact that neighboring components 4 normally or invariably abut each other. The utilization of cylindrical outer layers or shells 11 is desirable and advantageous on the additional ground that, when the configuration of the partition 1 is changed, the external surfaces of neighboring shells 11 merely roll along each other. The feature that the shells 11 and/or the layers 10 are at least slightly compressible or yieldable also contributes to a more satisfactory sound-absorbing action and to the possibility of changing the configuration of the partition with the exertion of a relatively small force. The shells 11 can consist of, or contain, a suitable sound-absorbing material to even further reduce the likelihood of penetration of sound across the partition.

While it is also possible to employ components 4 wherein the reinforcing cores surround the respective sound-absorbing layers 10 and/or the respective shells 11, the illustrated design is preferred at this time because the shells 11 and/or layers 10 can be readily deformed in response to changes of configuration of the assembled partition 1 and/or in response to stringing of the components 4 upon one, two or more flexible coupling elements 6. The utilization of cores 9 which are hollow contributes to a reduction of the overall weight of the partition and to lower cost of its components 4.

The provision of clamping devices 25 is desirable and advantageous on the additional ground that such devices reduce the likelihood of squashing or other undesirable extensive or excessive deformation of certain relatively soft components 4 if the softness or yieldability of one or more components exceeds the softness of yieldability of other components. This, in turn, reduces the likelihood of the formation of gaps between neighboring components 4.

The guides 26 not only serve to reduce wear upon the coupling elements 6 but they can also serve as a means for reducing the likelihood of axial shifting of the sound-absorbing layers 10 relative to the cores 9 and/or outer layers or shells 11 of the respective components 4 if the layers 10 are not positively secured to the respective cores and shells.

The number of feet 13 can be reduced to two or increased to three, four or more. FIG. 1 shows that each of the two outer components 4 is provided with a foot 13 and that two additional feet (indicated by broken lines) can be provided on the lower end portions of two intermediate components 4. The feet 13 not only allow for the formation of a clearance 2 along the lower ends of the components 4 but they also simplify the erection and proper positioning of the partition in an office, in a warehouse or in any other establishment wherein the improved partition is to be put to use.

If desired, the coupling elements 6 need not be made of a resilient material, such as spring steel. It often suffices if the coupling elements 6 are merely flexible so that they allow for a change in the shape of the assembled partition. An advantage of resilient coupling elements 6 (such as leaf springs) is that they exhibit a greater tendency to move the components 4 into, and to maintain such components in, a common plane.

As mentioned above, the distribution of passages 5 in the components 4 can be such that at least one group of components in the assembled partition 1 is staggered relative to the components 4 of at least one second group. This can be achieved by providing the components of the first group with passages which are distributed differently from the distribution of passages in the components of the second group or groups. The same result can be obtained if each component 4 is formed with a large number of passages, namely if the number of passages in each component 4 exceeds the number of coupling elements 6. This enables the person or persons in charge of assembling the partition to stagger any desired number of partitions relative to the other partitions.

The feature that the carriers 7 constitute hollow concavo-convex semi-cylindrical shells which are open toward the neighboring outer components 4 is desirable and advantageous because this simplifies the installation of the anchors 16 therein and the placing of such carriers against the respective outer components so as to enhance the appearance of the assembled partition by concealing the anchors 17. The tensional stresses to which the coupling elements 6 are subjected in a fully assembled partition 1 can be readily selected within a narrow range by properly selecting the number of components 4 as well as the deformability of some or all of the components. The total tensional stress which is applied to a coupling element 6 then equals the sum of individual tensional stresses which are generated by discrete deformed components 4.

It will be readily appreciated that the outer shells 11 of the components 4 can be omitted if the appearance of the sound-absorbing layers 10 is sufficiently satisfactory so that they do not affect the appearance of the assembled partition. As a rule, the provision of outer layers or shells 11 is desirable and advantageous because they can be readily furnished in any one of a variety of different colors as well as because they contribute to the sound-absorbing ability of the respective components 4.

The sound-absorbing ability of the improved partition 1 is enhanced due to the fact that the partition comprises a substantial number of substantially rod-shaped components 4. Such components impart to each of the two major surfaces of the assembled partition a substantially undulate shape which further contributes to absorption or reflection of sound. The sound-absorbing capacity of the improved partition can be varied within a wide range by appropriate selection of the diameters of the components 4 and/or by appropriate selection of the material which forms the sound-absorbing layers 10 and/or shells 11.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. A partition, particularly a mobile upright partition for use in offices and other establishments, comprising a plurality of substantially rod-shaped elongated parallel components disposed side by side and including a plurality of intermediate components and first and second outer components flanking said intermediate components, each of said components having a transversely extending passage and said passages being at least substantially aligned with each other; coupling means including a flexible coupling element extending through said passages and having first and second end portions adjacent said first and second outer components, respectively; first and second means for securing said end portions to the respective outer components so that said components can be moved relative to each other into and out of a common plane; and feet provided on at least some of said components and arranged to be placed into contact with a floor or another support, one of said feet being disposed in the region of each of said securing means and said feet being separably affixed to the respective components.

2. The partition of claim 1, wherein said coupling element comprises a band having a polygonal cross-sectional outline.

3. The partition of claim 1, wherein said components together form a row of abutting components which tension said coupling element.

4. The partition of claim 1, wherein said components are at least substantially vertical when the partition is in use.

5. The partition of claim 1, wherein said coupling element includes a leaf spring which contains a metallic material.

6. The partition of claim 1, wherein each of said components has several passages and said passages form several rows of aligned passages, said coupling means comprising a coupling element for each of said rows of passages.

7. The partition of claim 1, wherein at least some of said components are elongated cylinders having substantially diametrically extending transverse openings which constitute the respective passages, said cylinders having peripheral surfaces and the peripheral surfaces of neighboring cylinders being in contact with each other.

8. The partition of claim 1, wherein at least some of said components include elongated cores and layers of sound-absorbing material surrounding the respective cores.

9. The partition of claim 1, wherein said cores include tubes.

10. The partition of claim 1, further comprising means for clamping at least some of said components to said coupling element.

11. The partition of claim 1, wherein at least some of said components have guide means disposed in the respective passages and at least partially surrounding the respective portions of said coupling element.

12. The partition of claim 11, wherein said guide means consist of or contain a plastic material.

13. The partition of claim 1, wherein said feet include weight-enhancing metallic elements and roughened exposed surfaces engageable with the support.

14. The partition of claim 1, wherein each of said components has a first and a second end portion and said components include a first group of components having their passages disposed at first distances from their end portions and a second group of components having their passages disposed at different second distances from their end portions so that the components of the first group are staggered relative to the components of the second group in the longitudinal direction of said components.

15. The partition of claim 1, wherein at least one of said securing means comprises an anchor which is affixed to the respective end portion of said coupling element.

16. The partition of claim 15, wherein said anchor has two legs flanking the respective end portion of said coupling element, said at least one securing means further comprising a carrier adjacent one of said outer components and having internal abutments for said legs.

17. The partition of claim 1, wherein at least one of said securing means includes means for separably connecting the partition to a second partition.

18. The partition of claim 1, wherein at least some of said components are compressible in the direction of their respective passages and are assembled with neighboring components in compressed condition to exert a tensional stress upon said coupling element.

19. The partition of claim 1, wherein each of said components has the same length.

20. A partition, particularly a mobile upright partition for use in offices and other establishments, comprising a plurality of substantially rod-shaped elongated parallel components disposed side by side and including a plurality of intermediate components and first and second outer components flanking said intermediate components, each of said components having a transversely extending passage and said passages being at least substantially aligned with each other; coupling means including a flexible coupling element extending through said passages and having first and second end portions adjacent said first and second outer components, respectively; first and second means for securing said end portions to the respective outer components so that said components can be moved relative to each other into and out of a common plane; and feet provided on at least some of said components and arranged to be placed into contact with a floor or another support, said feet including weight-enhancing metallic elemetns and roughened exposed surfaces engageable with the support.

21. A partition, particularly a mobile upright partition for use in offices and other establishments, comprising a plurality of substantially rod-shaped elongated parallel components disposed side by side and including a plurality of intermediate components and first and second outer components flanking said intermediate components, each of said components having a transversely extending passage and said pasages being at least substantially aligned with each other; coupling means including a flexible coupling element extending through said passages and having first and second end portions adjacent said first and second outer components; and first and second means for securing said end portions to the respective outer components so that said components can be moved relative to each other into and out of a common plane, at least one of said securing means comprising an anchor which is affixed to the respective end portion of said coupling element, said anchor having two legs flanking the repective end poriton of said coupling element and said at least one securing means further comprising a carrier adjacent one of said outer components and having internal abutments for said legs.

22. The partition of claim 21, further comprising feet provided on at least some of said components and arranged to be placed into contact with a floor or another support.

23. The partition of claim 22, wherein one of said feet is disposed in the region of each of said securing means and said feet are separably affixed to the respective components.

24. The partition of claim 21, wherein said carrier has a concave internal surface provided with two undercut portions constituting said abutments.

25. The partition of claim 21, wherein said legs have end poritons which are bent toward the adjacent outer component and abut the respective undercut portions.

* * * * *